United States Patent [19]

Reardon

[11] Patent Number: 4,502,576

[45] Date of Patent: Mar. 5, 1985

[54] PORTABLE LOCKER

[76] Inventor: Dennis J. Reardon, 21315 Rumford Dr., Cupertino, Calif. 95014

[21] Appl. No.: 446,903

[22] Filed: Dec. 6, 1982

[51] Int. Cl.[3] ..... A45C 13/00; A45C 13/04; A63B 47/00; A63B 71/00

[52] U.S. Cl. ..... 190/18 R; 150/52 A; 190/122; 190/127; 206/287; 206/315.1; 206/315.9

[58] Field of Search ..... 190/110, 127, 18 R, 190/11, 122; 206/287, 287.1, 315.7, 315.1, 315.9; 150/52 A

[56] References Cited

U.S. PATENT DOCUMENTS

| | | | |
|---|---|---|---|
| 1,693,889 | 12/1928 | Dick | 206/315.7 X |
| 1,739,702 | 12/1929 | Wing | 206/315.7 X |
| 1,926,184 | 9/1933 | Schwer | 206/315.7 X |
| 2,099,924 | 11/1937 | Bressler | 190/18 R |
| 2,324,439 | 7/1943 | Thommen | 206/315.7 X |
| 2,990,924 | 7/1961 | Plunkett | 190/11 X |
| 3,079,967 | 3/1963 | Noel | 150/52 A |
| 4,095,636 | 6/1978 | Urion et al. | 150/52 A |
| 4,134,479 | 1/1979 | Crider, Jr. | 206/287 |
| 4,252,220 | 2/1981 | London et al. | 206/287 |
| 4,390,087 | 6/1983 | Goldfinger | 206/287 |

*Primary Examiner*—William Price
*Assistant Examiner*—Sue A. Weaver
*Attorney, Agent, or Firm*—Townsend and Townsend

[57] ABSTRACT

A portable locker for use in carrying sports equipment and clothing is capable of being mounted on a plane field or the like. The portable locker comprises a fabric bag on a metal frame forming a loop and having means extending from the frame adapted to be urged into soil to support the apparatus in an upright position.

12 Claims, 3 Drawing Figures

PORTABLE LOCKER

BACKGROUND OF THE INVENTION

1. Field of the Invention

This invention relates to an apparatus for carrying and temporarily storing sports equipment and sports clothing and particularly relates to an apparatus for deployment on a sporting field.

Participants in outdoor sporting events such as soccer frequently need a facility for storing equipment such as shoes, balls and jackets adjacent to playing field. There is a need to protect the equipment against moisture. A duffel bag or the like is not suitable since it is must be placed on the ground, thereby exposing the bag and equipment contained therein to ground moisture. Storage devices which are designed to be set upon the ground are generally relatively low structures having a low center of gravity so as not to be susceptible to being blown over. What is needed is a storage facility for sports equipment and the like which can be deployed adjacent a playing field or the like in an extended vertical position, and which resists being tipped or blown over.

2. Description of the Prior Art

U.S. Pat. No. 2,990,924 describes a utility carrying case with supporting staff, the staff being intended to be driven into the ground, and the carrying case being expansible to present a table.

U.S. Pat. No. 4,095,636 discloses a bowling ball carrying bag having a metal frame wherein one face of the bag may be opened for access to the ball in the supporting frame.

U.S. Pat. No. 3,730,241 describes a bowling ball bag and shoe rack similar in basic design to U.S. Pat. No. 4,095,636.

SUMMARY OF THE INVENTION

According to the invention, an apparatus for carrying and supporting sports equipment and clothing comprises a bag and a frame formed of a loop of rigid material enclosed within the bag and provided with means extendable from the apparatus for mounting the apparatus in a vertical position on a playing field or the like. A rod extending from the frame is adapted to be urged into soil upon application of foot pressure to a cross bar.

A specific embodiment of the apparatus includes shoulder straps and a handle for carrying the apparatus. A zipper may be provided in a face of the bag extending between the top and the bottom to permit access to the interior of the bag.

The apparatus permits support of sports equipment and the like in a convenient extended vertical position above ground. The apparatus in a properly deployed position resists being tipped or blown over and protects the contents against ground moisture.

The invention will be better understood by reference to the following detailed description taken in connection with the accompanying drawings.

DESCRIPTION OF SPECIFIC EMBODIMENTS

Figure 1:
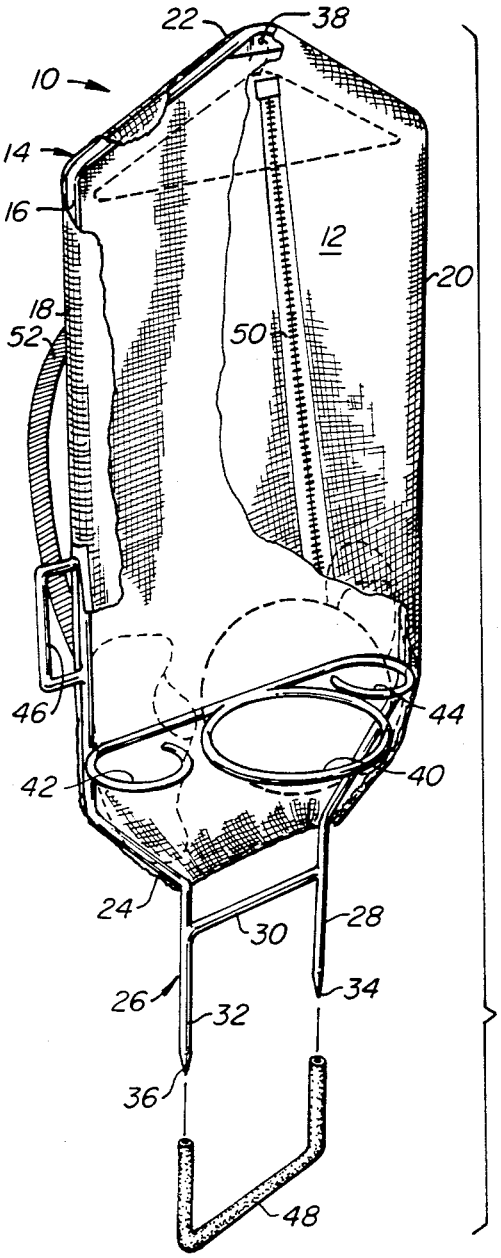
FIG. 1 is a perspective view in partial cutaway of one embodiment of the invention.

Referring to FIG. 1, there is shown one embodiment of the apparatus according to the invention, herein designated a portable locker 10. The portable locker 10 comprises a bag 12 and a rigid frame 14, preferably of metal rod material, enclosed within the bag 12. The frame 14 forms a loop 16 in one general plane. The loop has first and second lateral sides 18 and 20, a top side 22 and a bottom side 24 generally circumscribing the area used for equipment storage.

Extending from the bottom side 24 is means 26 for supporting the loop 16. The supporting means comprises at least a first rod 28 and a crossbar 30 and preferably also a second rod 32. The first and second rods 28, 32 are rigidly attached to the crossbar 30, the crossbar being disposed generally perpendicular to the first and second lateral sides 18, 20 and thereby generally parallel to ground level. The crossbar 30 is separated sufficiently from the bag 12 to permit a shoed foot to be placed across the bar 30 in order to urge the first and second rods into soil thereby to mount the portable locker 10 in an vertically extending position. The first and second rods 28 and 32 are therefore generally provided with pointed ends 34 and 36 so that the rods may more easily be implanted in soil.

Means are provided within the loop 14 for supporting various equipment. For example, an eyelet 38 may be provided along the top side 22 to receive a garment hanger. At least one hoop 40 may be provided mounted rigidly transversely of the first and second lateral sides 18, 20. A large hoop 40 may be adapted to a size to support a ball, such as a socker ball and smaller hoops 42, 44 may be provided to support shoes or the like. Means may be provided (not shown) for retaining the equipment within the bag at the intended support position in the event the portable locker 10 is carried in an extended horizontal position. For this purpose, a handle 46 may be provided along the lateral side 18. The frame 16 may be formed of one rigid rod of metal for durability and simplicity of construction. Rubber tubing 48 may be provided to protect against inadvertent injury due to the extension of the rods 28 and 32. The rubber tubing 48 may be slipped over the pointed ends 34 and 36. The rubber tubing 48 may be a single section or a section for each rod.

The bag 12 is preferably a waterproof fabric bag such as duck. The bag 12 is provided with a zipper 50 which extends from the top side 22 to the bottom side 24 along a face of the loop 16. When opened, the zipper 50 permits access to the interior of the bag 12 without removal of the bag 12 from the frame 14. The zipper preferably opens from bottom to top so that shoes and sports equipment and the like in the lower end of the bag can be removed without disturbing garments hanging from the eyelet at the top end.

As an aid to carrying the portable locker 10 shoulder straps 52 are provided along one face of the bag 12. The portable locker 10 is thereby more easily carried in a vertical position.

Figure 2:
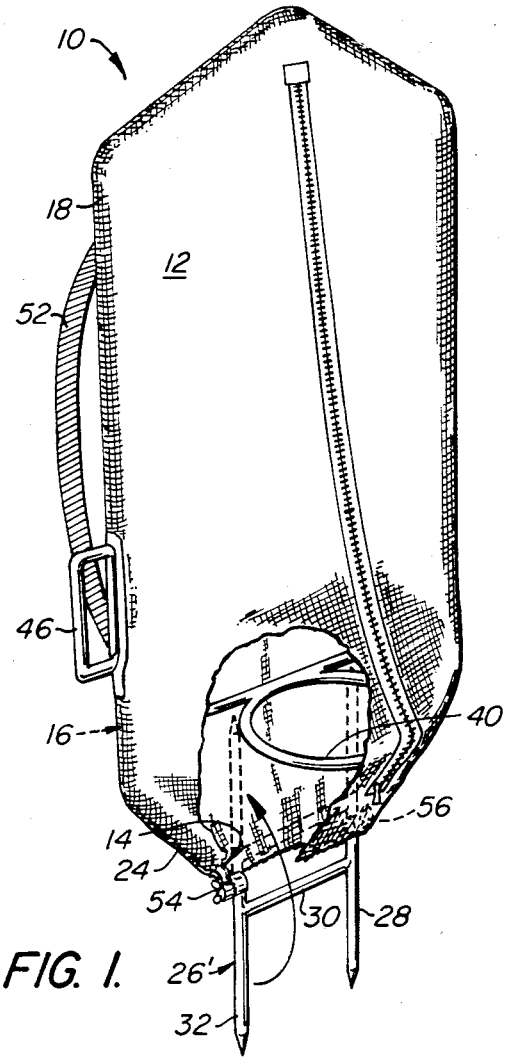
FIG. 2 is a perspective view in partial cutaway of a second embodiment of the invention.

Referring to FIG. 2, there is shown one alternative embodiment of the portable locker 10. This embodiment is essentially identical to the embodiment of FIG. 1 except that supporting means 26' is foldable. First and second rods 28 and 32 are rigidly joined by crossbar 30 below couplers 54 and 56. The couplers 54 and 56 join the frame 14 to the supporting means 26' and permit the supporting means 26' to rotate up against the bag 12. The couplers 54, 56 are disposed on an axis generally parallel to the crossbar 30 and the bottom side 24 of the loop 16.

Figure 3:
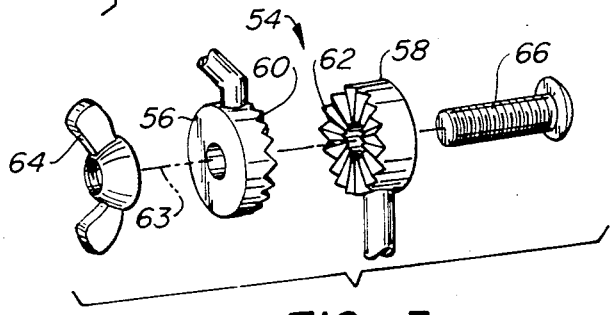
FIG. 3 is a perspective view of one embodiment of a coupler employed in the second embodiment according to the invention.

Turning to FIG. 3, there is shown one embodiment of a coupler 54 according to the invention. The coupler 54 includes a first plate 56 and a second plate 58 each having faces 60 and 62 disposed to abut one another. The coupler further includes tightening means such as a wing nut 64 and matching bolt 66 threadably joined along an axis through the first plate 56 and second plate 58. When the plates 56 and 58 are tightened against one another, the two faces 60 and 62 engage one another to prevent the supporting means 26' from rotating with respect to the frame 14.

The invention has been described with respect to specific embodiments. Other embodiments will be apparent to those of ordinary skill in this art. For example, the invention can be adapted for use not only for soccer, it might also be used for softball, baseball, cricket, football, field hockey, or virtually any other outdoor game where off-the-ground protection is desired for sports equipment and related clothing. The bag may be made removable for cleaning and the like and pockets may be included on the interior or on the exterior of the bag for carrying other items. It is therefore not intended that this invention be limited except as indicated by the appended claims.

What is claimed is:

1. An apparatus for carrying and supporting sports equipment and clothing comprising;

a bag; and a frame enclosed within said bag, said frame including a loop of rigid material in one plane, said loop having an opposing first and second lateral sides and opposing top and bottom sides, said rigid material frame further including means for supporting said loop, said loop supporting means for extending outwardly from said bottom side of said loop, said supporting means comprising first and second parallel rods and a cross bar rigidly attached to said rods, said cross bar being disposed generally perpendicular to said first and second lateral sides, said cross bar for receiving foot pressure to urge said loop supporting means into soil for mounting said apparatus in a vertical position on a playing field or the like, said apparatus further including tube means adapted to attach between said first rod and said second rod for covering exposed pointed ends of said first rod and said second rod.

2. The apparatus according to claim 1 wherein said frame further includes means attached between said elongate sides for supporting equipment, including footwear.

3. The apparatus according to claim 2 wherein said equipment supporting means includes a hoop transverse of said loop for supporting a ball.

4. The apparatus according to claim 1 further including means for receiving a garment hanger at a position along said top side of said loop.

5. The apparatus according to claim 1 wherein said bag includes a first face having a zipper between said top side and said bottom side of said loop for opening said face of said bag.

6. The apparatus according to claim 1 wherein said bag is constructed of a flexible substantially waterproof fabric.

7. The apparatus according to claim 1 wherein said bag includes a second face having attached shoulder straps between said top side and said bottom side.

8. The apparatus according to claim 1 wherein said frame includes a handle extending from a side of said loop.

9. The apparatus according to claim 8 wherein said handle extends from said first lateral side of said loop.

10. The apparatus according to claim 1 wherein said loop supporting means is contiguous with said loop.

11. The apparatus according to claim 1 further including means for attaching said loop supporting means to said loop, said attaching means permitting said loop supporting means to fold upon said loop.

12. The apparatus according to claim 11 wherein said attaching means comprises at least one locking coupling means mounted on an axis parallel to said bottom side of said loop between said frame and said loop supporting means, each said coupling means comprising a tightening means, a first plate having a first tooth face and a second plate having a second toothed face, said first face being disposed to abut to said second face for inhibiting rotation of said coupling means upon application of pressure through said tightening means.

* * * * *